US009156575B2

(12) United States Patent
Potempa et al.

(10) Patent No.: US 9,156,575 B2
(45) Date of Patent: Oct. 13, 2015

(54) BAGGING, SEALING, AND LABELING SYSTEM AND METHOD

(75) Inventors: Michael W. Potempa, Libertyville, IL (US); Matthew T. Grennie, Wadsworth, IL (US); Ronald R. Powell, Roseburg, OR (US)

(73) Assignee: Signode Industrial Grop LLC, Glenview, IL (US)

( * ) Notice: Subject to any disclaimer, the term of this patent is extended or adjusted under 35 U.S.C. 154(b) by 827 days.

(21) Appl. No.: 13/347,502

(22) Filed: Jan. 10, 2012

(65) Prior Publication Data

US 2012/0186197 A1 Jul. 26, 2012

Related U.S. Application Data

(60) Provisional application No. 61/435,048, filed on Jan. 21, 2011.

(51) Int. Cl.

| | |
|---|---|
| ***B65B 3/02*** | (2006.01) |
| ***B65B 3/04*** | (2006.01) |
| ***B65B 51/14*** | (2006.01) |
| ***B65B 7/06*** | (2006.01) |
| ***B65B 9/14*** | (2006.01) |
| ***B65B 27/12*** | (2006.01) |

(52) U.S. Cl.

CPC ..... *B65B 51/146* (2013.01); *B65B 7/06* (2013.01); *B65B 9/14* (2013.01); *B65B 27/125* (2013.01)

(58) Field of Classification Search

CPC ..... B65B 35/20; B65B 35/22; B65B 35/50; B65B 41/12; B65B 41/14; B65B 43/04; B65B 43/46; B65B 43/48; B65B 3/02; B65B 3/04

USPC ..... 53/415, 455, 252, 463, 468, 249, 255, 53/284.7; 493/11

See application file for complete search history.

(56) References Cited

U.S. PATENT DOCUMENTS

| | | | | | |
|---|---|---|---|---|---|
| 3,044,231 | A | | 7/1962 | Blais et al. | |
| 4,007,575 | A | * | 2/1977 | Hartman | 53/447 |
| 4,352,263 | A | * | 10/1982 | Andrews, Jr. | 53/436 |
| 4,495,751 | A | * | 1/1985 | Galbiati | 53/576 |
| 4,616,472 | A | * | 10/1986 | Owensby et al. | 53/459 |
| 4,757,667 | A | * | 7/1988 | Elsner | 53/415 |
| 4,918,905 | A | * | 4/1990 | Hoekstra | 53/411 |
| 4,995,219 | A | | 2/1991 | Hicks | |
| 5,024,042 | A | * | 6/1991 | Meyer | 53/168 |
| 5,054,274 | A | | 10/1991 | Tanaka | |
| 5,058,364 | A | * | 10/1991 | Seiden et al. | 53/455 |
| 5,088,271 | A | | 2/1992 | Westaway | |
| 5,117,614 | A | * | 6/1992 | Johnsen | 53/540 |
| 5,181,365 | A | * | 1/1993 | Garvey et al. | 53/455 |

(Continued)

OTHER PUBLICATIONS

International Search Report and the Written Opinion of the International Searching Authority issued in connection with PCT/US2012/020961 on May 1, 2012.

*Primary Examiner* — Gloria R Weeks

(74) *Attorney, Agent, or Firm* — Levenfeld Pearlstein, LLC

(57) ABSTRACT

A load packaging system includes a bag feeder for pulling a length of bag material, a mechanism for cutting and sealing the bag material to form a bag with a first sealed end, and a gripping device for opening the bag. The system also includes a load pusher for pushing the load into the bag, a package sealer for sealing a second end of the bag, and a labeling device for printing and applying one or more labels onto the load.

14 Claims, 10 Drawing Sheets

(56) References Cited

U.S. PATENT DOCUMENTS

| | | | | |
|---|---|---|---|---|
| 5,327,704 | A * | 7/1994 | Hoekzema et al. | 53/459 |
| 5,337,539 | A * | 8/1994 | Barton | 53/413 |
| 5,540,032 | A * | 7/1996 | Sosnik et al. | 53/415 |
| 5,551,212 | A * | 9/1996 | Odenthal | 53/397 |
| 5,661,948 | A * | 9/1997 | Odenthal | 53/131.5 |
| 5,722,217 | A * | 3/1998 | Cloud | 53/455 |
| 6,093,138 | A * | 7/2000 | Sorenson et al. | 493/136 |
| 6,170,237 | B1 * | 1/2001 | Wipf | 53/455 |
| 6,253,817 | B1 * | 7/2001 | Edwards et al. | 156/351 |
| 6,564,527 | B1 * | 5/2003 | Focke et al. | 53/53 |
| 6,823,650 | B2 * | 11/2004 | Recchia, Jr. | 53/415 |
| 7,386,968 | B2 * | 6/2008 | Sperry et al. | 53/411 |
| 7,987,651 | B2 * | 8/2011 | Beeland et al. | 53/284 |
| 8,096,097 | B2 * | 1/2012 | Haschke | 53/413 |
| 8,235,712 | B1 * | 8/2012 | Lewis | 432/121 |
| 2002/0108355 | A1 * | 8/2002 | Vignoli | 53/459 |
| 2005/0284107 | A1 * | 12/2005 | Concetti | 53/413 |
| 2008/0313998 | A1 | 12/2008 | Ligon et al. | |
| 2011/0036055 | A1 * | 2/2011 | Shibagaki | 53/266.1 |

* cited by examiner

BAGGING, SEALING, AND LABELING SYSTEM AND METHOD

CROSS-REFERENCE TO RELATED APPLICATION DATA

This application claims the benefit of priority of U.S. Provisional Patent Application Ser. No. 61/435,048, filed Jan. 21, 2011, the disclosure of which is incorporated herein in its entirety.

BACKGROUND

Packaging and processing a load for shipment or delivery typically involves a number of steps. In one example, a load is placed in a bag and/or wrapped by packaging material at a first station. The load may then be labeled with identifying and tracking information at the first station or conveyed for labeling at a different labeling station. Once labeled, the load may then be conveyed to a delivery area for shipment.

Some or all of these steps may be performed manually. However, even with the assistance of lifting and transporting equipment and machinery, such as forklift trucks, cranes, and the like, the packaging and processing of a large and/or heavy load, such as a cotton bale, can be a labor intensive procedure. In addition, errors may occur during one or more of the steps. As such, it would be useful to be able to identify and correct for such errors before proceeding with a subsequent step.

Accordingly, there is a need for a system and method which automates such a packaging and processing procedure for loads of any size, which reduces any necessary manual labor, and is efficient and reliable. Further, it would be desirable for such a system and method to be fairly integrated to minimize the amount of space occupied on a packaging and processing facility floor.

SUMMARY

Various embodiments of the present disclosure provide a load packaging system that includes a bag feeder for pulling a length of bag material, a mechanism for cutting and sealing the bag material to form a bag with a first sealed end, and a gripping device for opening the bag. The system also includes a load pusher for pushing the load into the bag, a package sealer for sealing a second end of the bag, and a labeling device for printing and applying one or more labels onto the load.

Other embodiments of the present disclosure provide a method for packaging a load utilizing an automated load packaging system, which includes pulling a length of bag material, cutting and sealing the bag material to form a bag with a first sealed end, and opening a second open end of the bag. The method further includes the steps of pushing a load into the bag, subsequently pushing the load into the bag, sealing the second open end of the bag to create a bagged load, and printing and applying one or more labels onto the bagged load.

In this manner, the present disclosure provides an enhanced system and method for packaging a load, which reduces the amount of manual labor involved and is efficient, reliable, and capable of processing large and/or heavy loads. In addition, the system and method may include integrated sensors for identifying errors that occur during the packaging of a load and, thus, facilitating the correction of such errors. Further, such a system and method for packaging a load is fairly integrated to minimize the amount of space occupied on a packaging and processing facility floor.

Other objects, features, and advantages of the invention will be apparent from the following detailed disclosure, taken in conjunction with the accompanying sheets of drawings, wherein like numerals refer to like parts, elements, components, steps, and processes.

DETAILED DESCRIPTION

Figure 1:
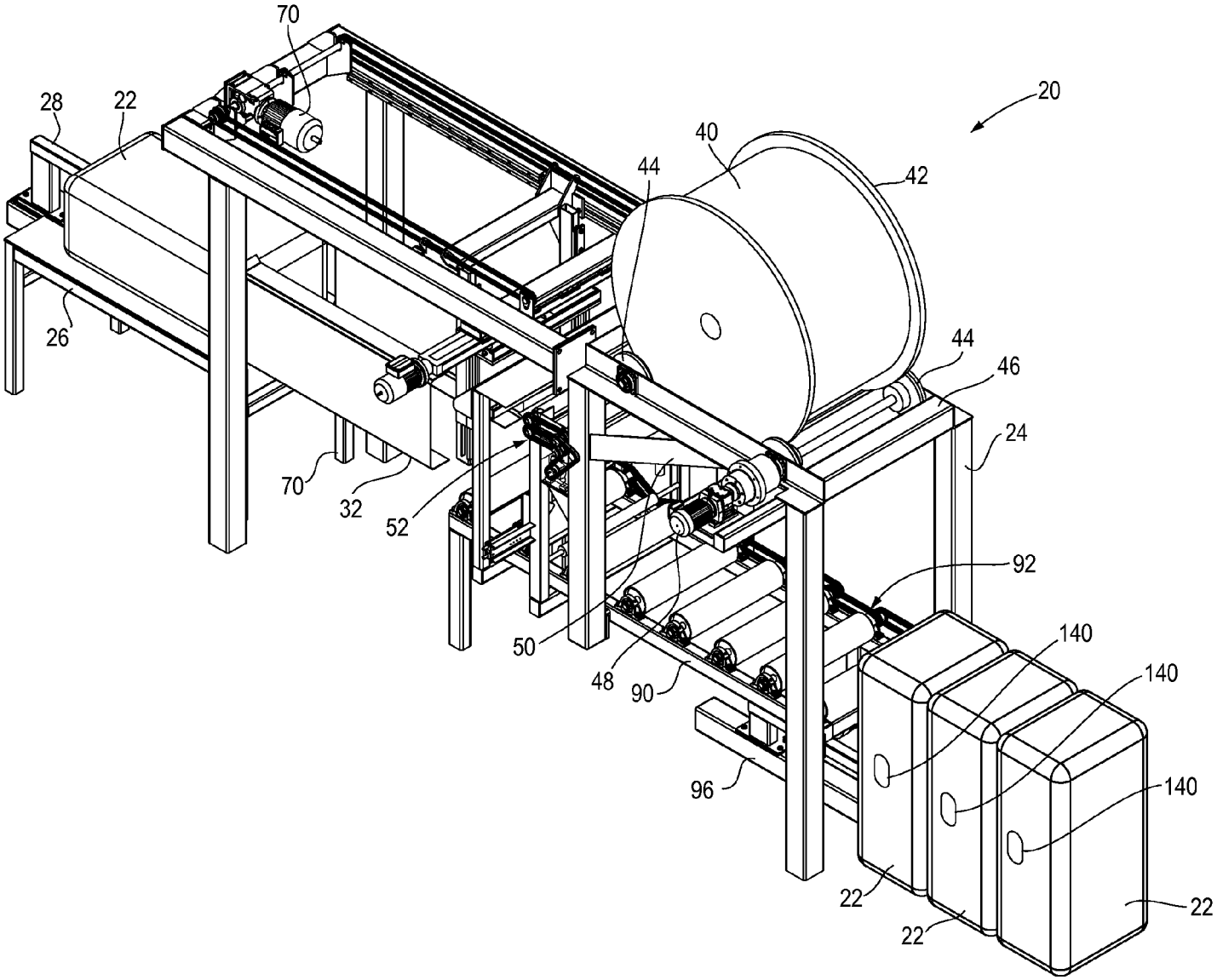
FIG. 1 is a perspective view of a bagging system in accordance with an embodiment of the present disclosure.

While the present disclosure is susceptible of embodiment in various forms, there is shown in the drawings and will hereinafter be described one or more embodiments with the understanding that the present disclosure is to be considered illustrative only and is not intended to limit the disclosure to any specific embodiment described or illustrated.

Referring now to FIGS. 1-4, a bagging system 20 according to one embodiment is configured to bag, seal, and/or label a load 22, which in one non-limiting example can be a compressed cotton bale. Generally, compressed cotton bales in an industrial setting, e.g., bales packaged by cotton gins, are about 21 inches (about 53 cm) in height, 28 inches (about 71 cm) in width, 55 inches (about 140 cm) in length, and weigh about 500 pounds (about 227 kg). The bagging system 20 includes a frame assembly 24 and a load infeed table 26 disposed at one end of the frame assembly. A load pusher 28 coupled to the infeed table 26 is actuated by a motor 30 to move a load 22 placed on the infeed table downstream into a load alignment or positioning chute 32. As more clearly seen in FIG. 2, the infeed table 26 includes a generally central channel 34 along which the load pusher 28 is actuated to move the load 22 through the chute 32. In other embodiments, the pusher 28 may be mounted above or along a side of the table 26 and actuated along the table to move the load 22 through the chute 32. The table 26 may further include rollers (not shown) or other structures to facilitate moving the load 22 into the chute 32.

The bagging system 20 includes bag material 40 rolled on a bag spool 42. In one example, the bag material 40 is a woven polypropylene in the form of a continuous gusseted tube that is rolled onto the bag spool 42. According to one non-limiting example, the bag material 42 is a tube that can be expanded to about 31 inches (about 79 cm) in width and about 22 inches (about 56 cm) in height, the bag spool 42 has a diameter of about 60 inches (about 152 cm), the roll of bag material has a diameter of about 16 to about 54 inches (about 41 to about 137 cm), the weight of a full bag spool is about 900 pounds (about 408 kg), and there are about 450 cotton bale bags per full bag spool.

Figure 4:
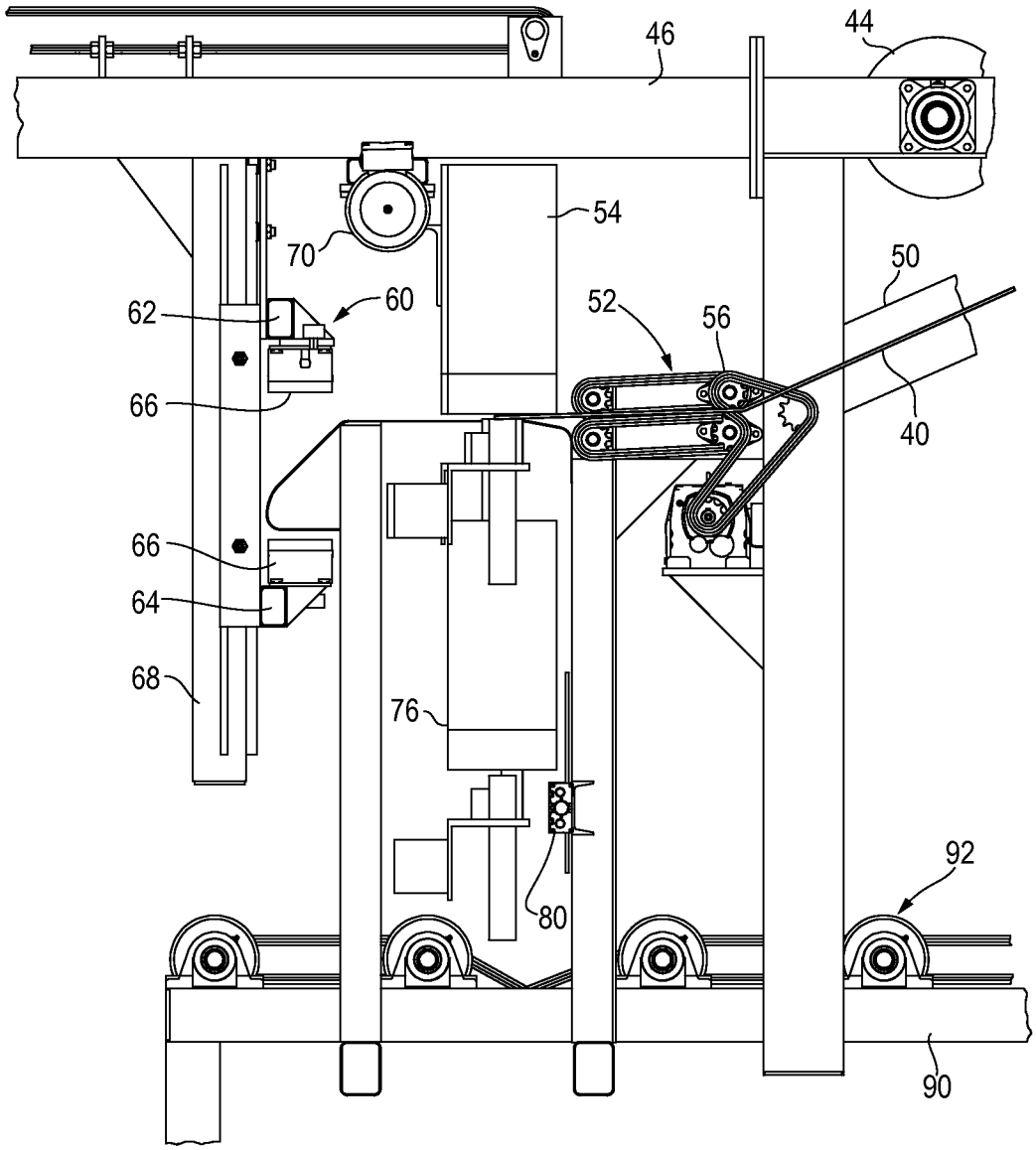
FIG. 4 is an enlarged side elevational view of a portion of the bagging system of FIG. 1.

The bag spool 42 is disposed on rollers 44 coupled to an upper portion 46 of the frame assembly 24. The rollers 44 may be rotated by a motor 48 to facilitate unwinding bag material 40 from the spool 42. The rollers 44 may also include braking mechanisms to provide increased control over the bag spool 42 as the bag material 40 is unrolled, as would be apparent to one of ordinary skill in the art. The bag material 40 is guided by a chute 50 towards a bag feeder 52 that includes any known mechanism for feeding the bag material to a slitter/sealer mechanism 54. Referring more particularly to FIG. 4, the bag feeder 52, in one example, includes opposing rollers or belts 56 that are driven by a motor 58 to moving the bag material 40 to the slitter/sealer mechanism 54. The slitter/sealer mechanism 54 cuts a length of bag material 40 and seals one end thereof, for example, by a sonic welding technique.

The vacuum gripper 60 includes first and second vacuum bars 62, 64, respectively, each vacuum bar with one or more suction cups 66. The vacuum bars 62, 64 are spaced apart from each other and are mounted generally parallel to the ground. However, the vacuum bars 62, 64 can be mounted in different configurations, such as generally perpendicular to the ground, without departing from the spirit of the present disclosure. The vacuum bars 62, 64 are movably coupled to a support arm 68, which is further movably coupled to the frame assembly 24. In the present embodiment, one or more motors 70 is operatively coupled to the vacuum bars 62, 64 and the support arm 68 for moving the vacuum bars 62, 64 generally vertically towards and away from one another and for moving the support arm 68 generally horizontally, forward and backward along the direction of travel of the load 22 through the bagging system 20. The bag feeder 52, the slitter/sealer 54, and the vacuum gripper 60 are operated together to pull a length of the bag material 40 from the spool 42, open the bag material, and feed the bag material over the chute 32, as will be described in more detail hereinafter.

In addition, the bagging system includes a package sealer 76, for sealing an end of the bag material 40 around the load 22 and a labeling system 80 for labeling the bagged load. The package sealer 76 may be similar to the slitter/sealer mechanism 54 described above and include a sonic welding mechanism for sealing the end of the bag material 40. Alternatively, the package sealer 76 may include mechanisms for folding an open end of the bag material 40 around the load 22 and securing the bag material closed, such as by mechanical fasteners inserted through the bag material and into the load, by adhesive, heat sealing unit, and the like. The labeling system 80 can be adapted to print, apply, and check for labels on multiple sides of the bagged load. For example, the labeling system 80 may include a first printer arranged on one side of the load 22 as the load passes thereby and a second printer (not shown) disposed on an opposing side of the load or at the end of the system, as the load passes thereby. In one example, the labeling system 80 includes one or more Platinum Series Label Print and Apply Systems commercially available from Diagraph, an ITW company, of St. Charles, Mo. Other labeling system can be used. Such a labeling system may include a sensor to detect the presence of a load, one or more imaging units to print information on a label, one or more label applying tabs, a sensor to detect the presence of the label, and other components.

The bagging system 20 further includes an outfeed table 90 that includes a plurality of rollers 92. In the present example, the rollers 92 are powered by a motor 94 to convey a bagged load 22 forward and backward on the outfeed table 90. The system 20 also includes a load pusher 96 that may be coupled to the motor 94 and actuated to push stacked loads 22 away from the outfeed table 90. The load pusher 96 can be mounted to the outfeed table 90 or some other portion of the system 20 or mounted to the floor.

Figure 2:
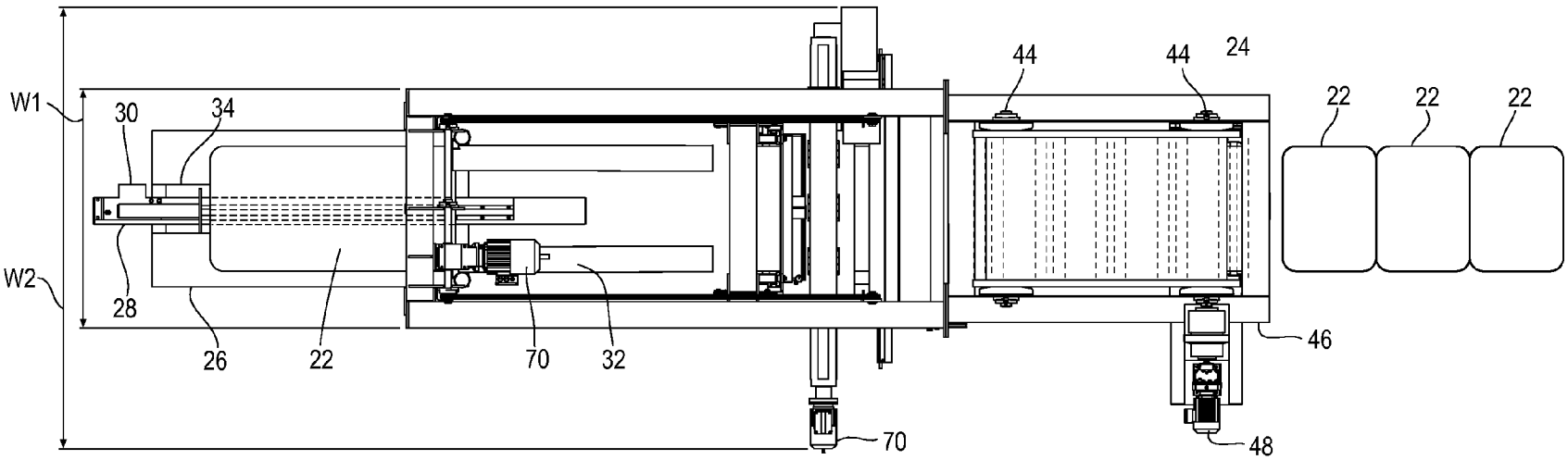
FIG. 2 is a plan view of the bagging system of FIG. 1 with portions removed for clarity of illustration.
Figure 3:
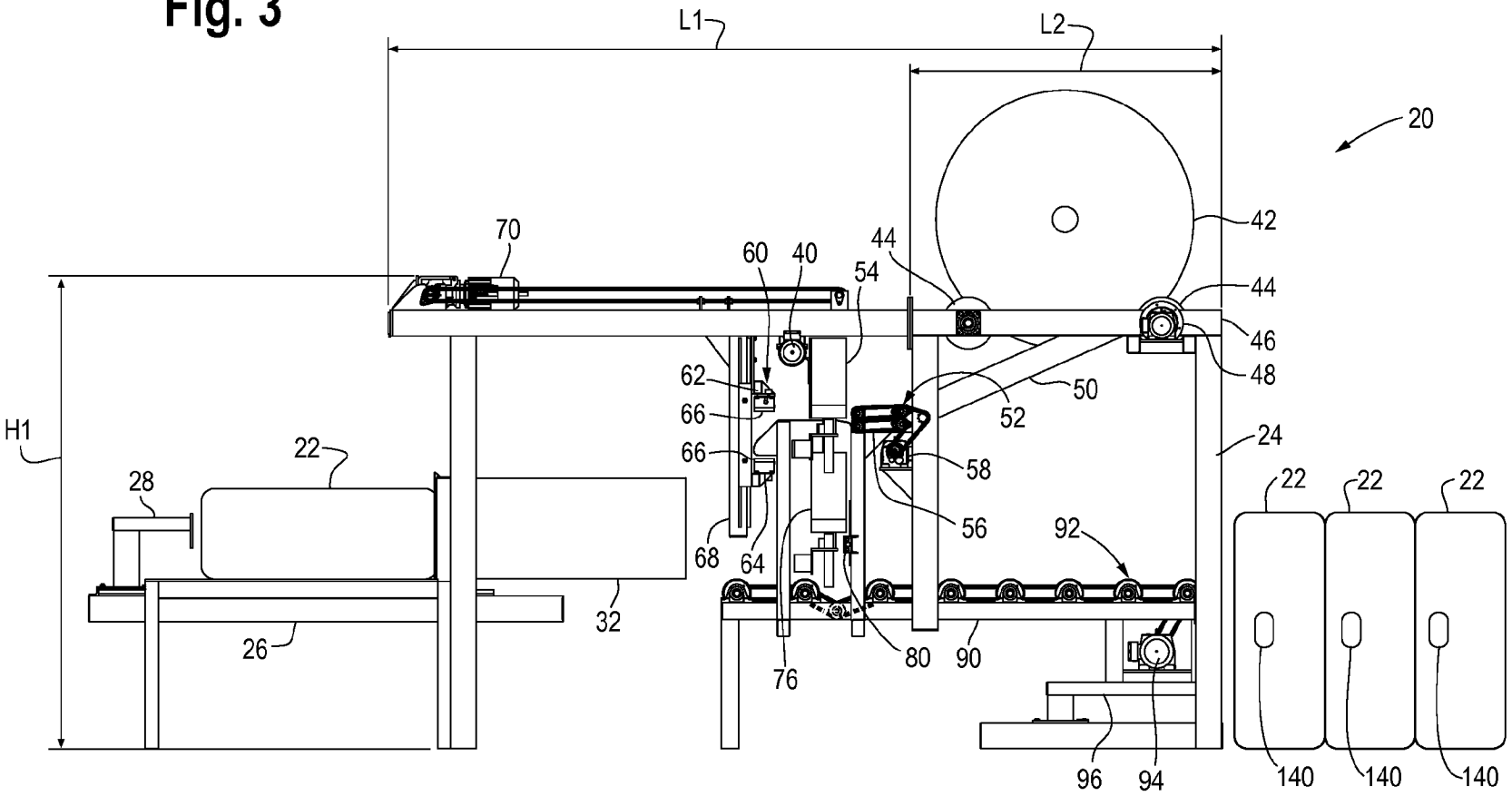
FIG. 3 is a side elevational view of the bagging system of FIG. 1.

In one example, the system 20 is designed to fit in approximately the same space as existing manual bagging and labeling operations for industrial sized cotton bales. In the illustrated example and as seen in FIG. 2, the system 20 may have a primary width W1 of about 53.625 inches (about 136 cm) and a secondary width of about 99 inches (about 251 cm). Referring more particularly to FIG. 3, the system may have a primary height H1 of about 110 inches (about 279 cm), a main length L1 of about 194 inches (about 493 cm), and a length L2 of a bag spool support section of about 72.5 inches (about 184 cm). These general dimensions provide sufficient space for an operator to place a bag manually over the chute 32, in the event of a system failure, for example. In one example, finished bags can be produced by the system 20 and stored for future use.

Figure 5:
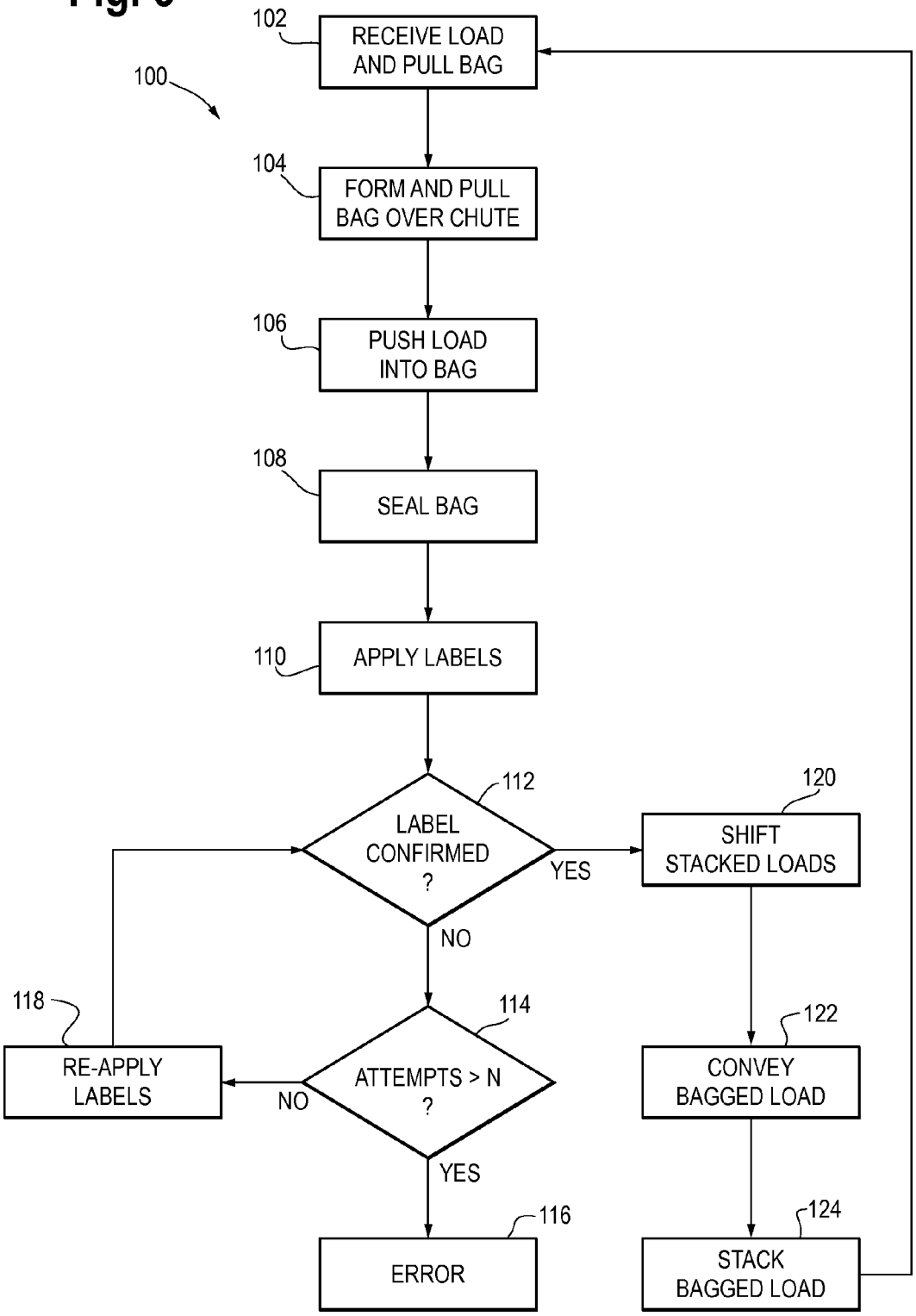
FIG. 5 is a flowchart of an example bagging process that may be implemented on the bagging system of FIG. 1, in accordance with an embodiment of the present disclosure.
Figure 6:
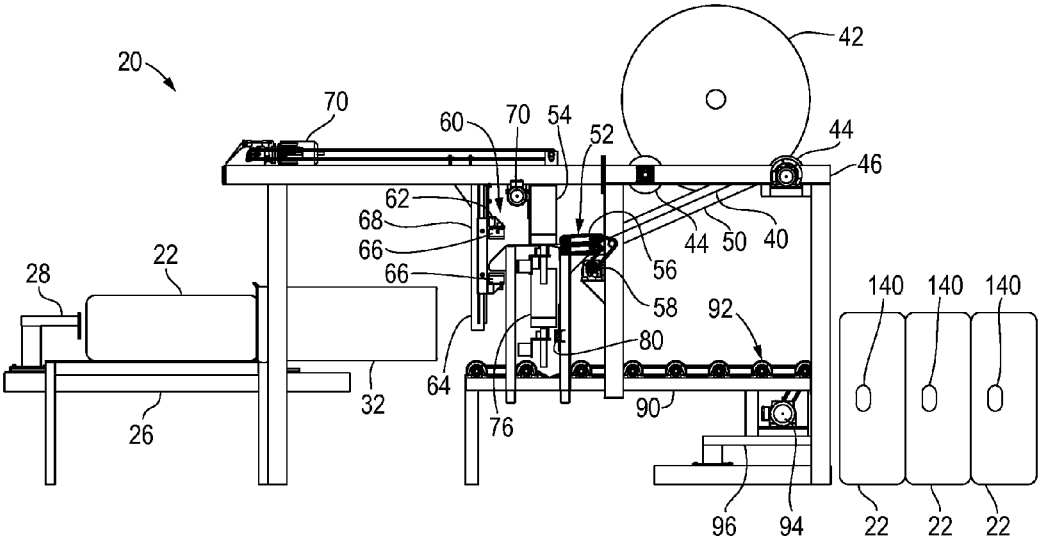
FIGS. 6-11 are side elevational views of the bagging system of FIG. 1 as the bagging system performs the bagging process of FIG. 5.

Referring now to FIG. 5, one example embodiment of the bagging system 20 of the present disclosure operates according to a sequence or process 100. As indicated by block 102, the system receives a load 22, such as a cotton bale weighing approximately 500 pounds after it has been compressed in a baling unit and strapped or "tied" in a prior operation. The strapped bale 22 is transported from the baler to the bagging system 20 using known conveying equipment. Once in position within the framework 24 of the system 20, the pusher 28 begins to move the bale 22 forward into the tapered chute 32. The system 20 also begins to pull the bag material 40 from the spool 42 in preparation for subsequent steps. FIG. 6 illustrates an example of the system 20 receiving the load 22 on the infeed table 26.

As indicated by block 104, which can be performed prior to, simultaneously with, or subsequently to receiving the load 22 (block 102), the vacuum gripper 60 is activated to pull the bag material 40 out, apart, and over the chute 32. Further, the system 20 forms a bag by measuring a proper length of the bag material 40 to accommodate the load 22 and the slitter/sealer 54 cuts the bag material once the proper length has been metered and closes or forms an end of the bag using sonic welding technology or other known sealing technology, such as using adhesive, a heat sealing unit, or mechanical fasteners. In one example, the length of the bag is about 80 inches (about 203 cm).

Figure 7:
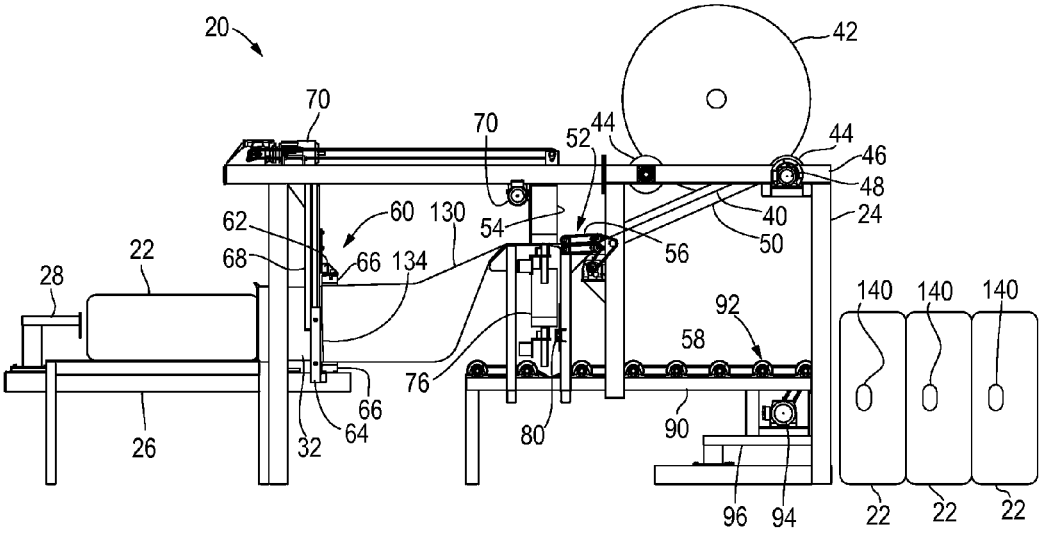
Figure 8:
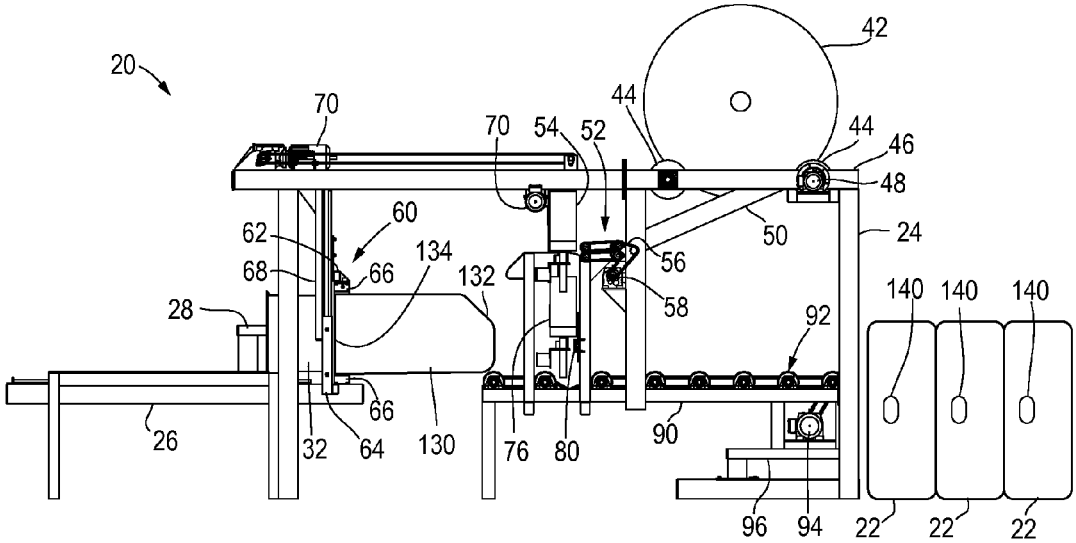

FIG. 7 illustrates the vacuum gripper 60 pulling the bag material 40 out, apart, and over the chute 32. FIG. 8 illustrates a bag 130 formed for the load 22 with one end 132 cut and sealed and another open end 134. FIG. 8 also illustrates the load 22 being pushed by the load pusher 28 into the bag 130, as indicated by block 106. This can be performed concurrently or subsequently to pulling the bag material 40 and/or bag 130 over the chute 32.

Figure 9:
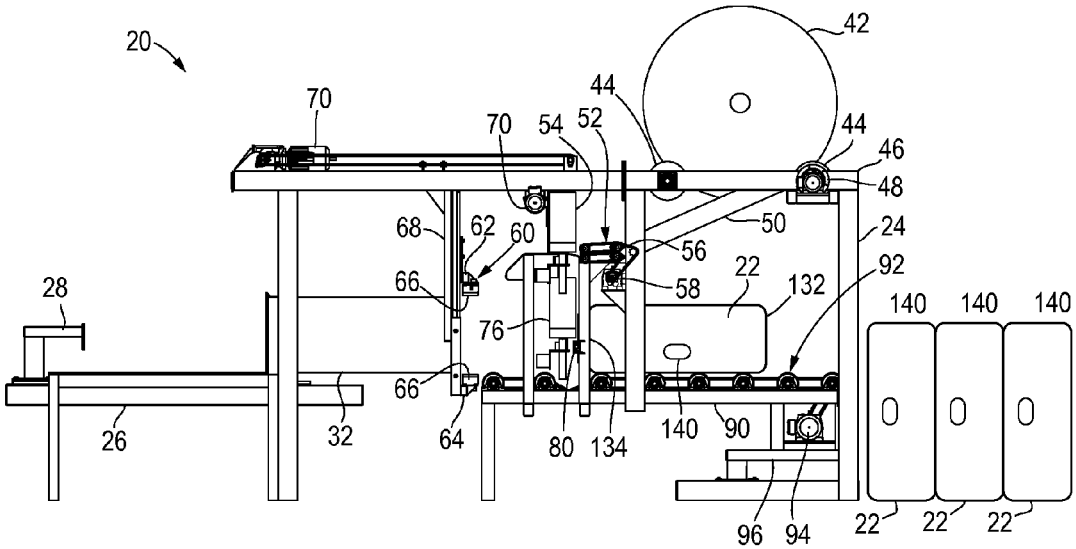

After the load 22 is pushed into the bag 130, the bagged load 22 is conveyed downstream through the package sealer 76 which seals the open end 134 of the bag 130, as indicated by block 108. In one example, the package sealer 76 folds the open end 134 of the bag 130 using a combination of mechanical devices and air nozzles and closes or seals the end with a sonic welding mechanism and/or by applying heat via a heat bar or a mechanical fastener. As indicated by block 110, the bagged load 22 is conveyed past the labeling system 80 and one or more labels 140 are applied to the bagged load 22. In one embodiment, the bagged load 22 is moved to the labeling system 80 where identification labels are printed and applied, such as with ITW Diagraph PA6000 or other equipment, to opposite sides of the load 22 in accordance with government specifications. FIG. 9 illustrates an example of the bagging system 20 as the load 22 is conveyed past the labeling system 80 and the label 140 applied.

As indicated by block 112, the presence and legibility of the applied labels 140 are confirmed. In one example, the labeling system 80 includes scanners that are used to confirm the presence and legibility of the labels 140. If a label 140 is not present or is illegible, control passes to a block 114 to determine if the number of attempts to apply one or more correct labels is greater than a certain number N. In one example, if the number of attempts N is greater than two, control passes to a block 116 and the system 20 will stop and send an alarm indicating that repair is needed. If the number of attempts is less than N, control passes to a block 118 and the system 20 will automatically reprint and reapply an identical replacement label 140. The powered rollers 92 of the outfeed table 90 can be controlled to convey the bagged load 22 back and forth past the labeling system 80, as needed, to apply and reapply the one or more labels 140.

Figure 10:
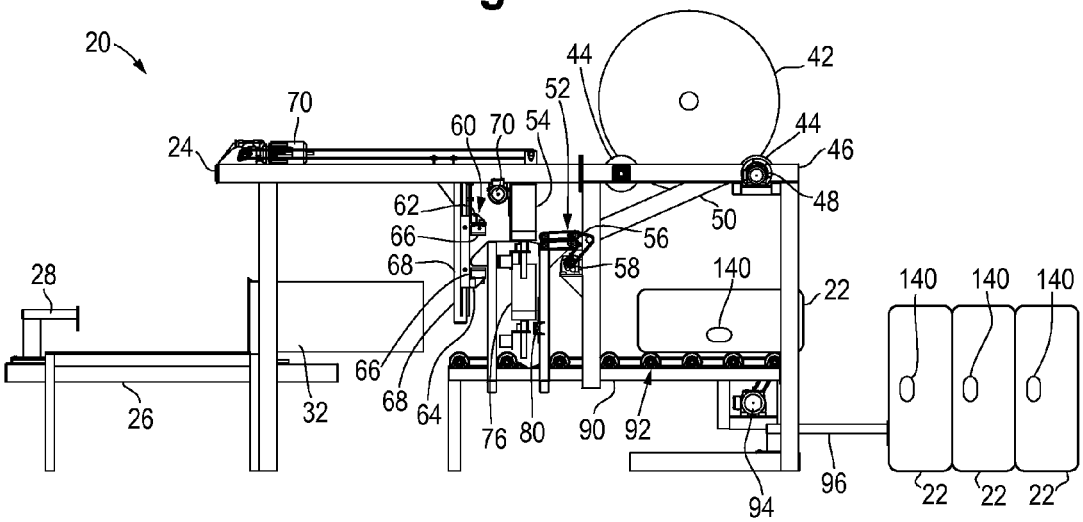
Figure 11:
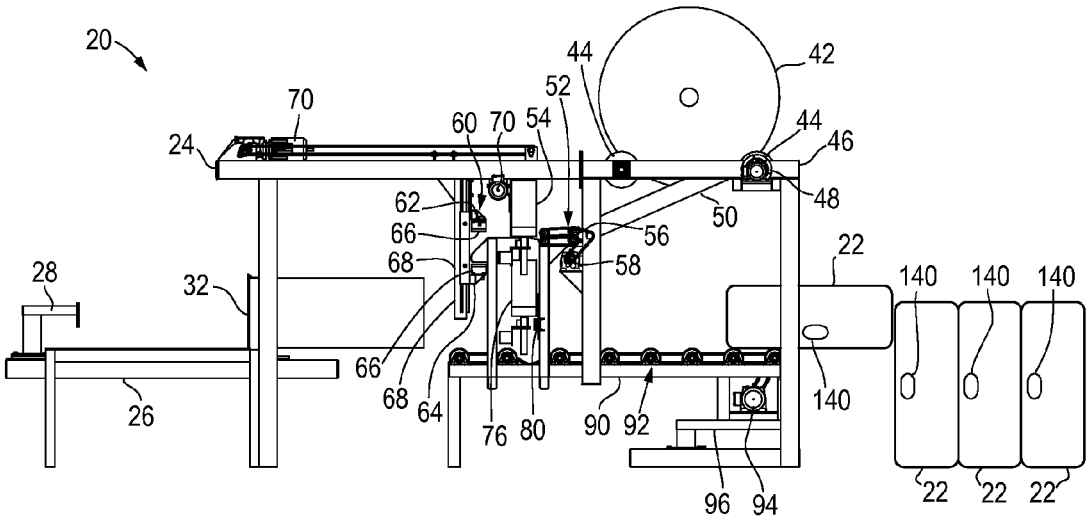

If the presence and legibility of labels 140 is confirmed, any stacked loads 22 disposed at the end of the outfeed table 90 are shifted or moved away from the outfeed table by the load pusher 96, as indicated by block 120. FIG. 10 illustrates an example of the system 20 moving stacked loads 22 away from the outfeed table 90 in preparation for a next bagged load to be stacked. In other embodiments, moving or shifting the stacked loads can be performed at other times during the process, as would be apparent to one of ordinary skill in the art.

In the illustrated example process 100, after the stacked loads are shifted or moved away from the outfeed table 90, the bagged load 20 is conveyed until it tips off the outfeed table 90 and is stacked along with any other bagged loads, as indicated by blocks 122 and 124, respectively. In one example, when four bagged loads 22, such as bagged cotton bales, are ready for handling, a clamp equipped fork lift picks them up and loads them on a truck. After the bagged loads are stacked, the sequence 100 repeats beginning at block 102 to process another load 22. In other embodiments, the sequence 100 can begin to process another load at other times, such as immediately after a bagged load has been sealed (block 108).

In another example of the process of FIG. 5, while a load 22 is being received by the system (block 102), the bag material 40 advances about 8 inches (about 20 cm) into the vacuum gripper 60 (block 102). The process of advancing the bag material 8 inches takes about one second. To facilitate pulling the bag material 40 over the chute 32 and forming the bag 130 (block 104), the suction cups 66 grip the bag material 40 and the support arm 68 is moved to pull about 80 inches of bag material at about 90 fpm while the vacuum bars 62, 64 are moved down and apart to open the end of the bag material and move the bag material over the chute 32. The slitter/sealer 54 then traverses across the bag material 40 to cut and seal the same at about 90 fpm (block 104). In one example, the process of cutting and sealing the bag material takes about 8 seconds.

The load pusher 28 pushes the load 22 into the bag 140 as the vacuum gripper 60 follows the movement of the load towards its starting position proximate the slitter/sealer 54 (block 106). This process takes about 6 seconds. The bagged load 22 is then conveyed forward about 8.5 feet (about 259 cm) at about 90 fpm, which takes about 8 seconds. During this process of conveying the bagged load 22 forward (block 106), the suction cups 66 release the bag material 40 and return to the starting position and a cycle for bagging a subsequent load can begin.

The bagged load 22 is conveyed through the package sealer 76, which, in one example, utilizes folding arms and guides to flatten the open end 134 of the bag 130, which is then welded or otherwise sealed (block 108). The process of folding and sealing takes about 12 seconds. Thereafter, any stacked loads 22 at the end of the outfeed table 90 are shifted about 42 inches (107 cm) by the pusher (block 120) and the bagged load is conveyed forward until it rolls 90 degrees and is lowered to a vertical position (blocks 122 and 124). The process of shifting stacked loads, conveying, and lowering the bagged load takes about 24 seconds. The various processes described hereinabove may be performed in longer or shorter timeframes without departing from the spirit and scope of the present disclosure.

Figure 12:
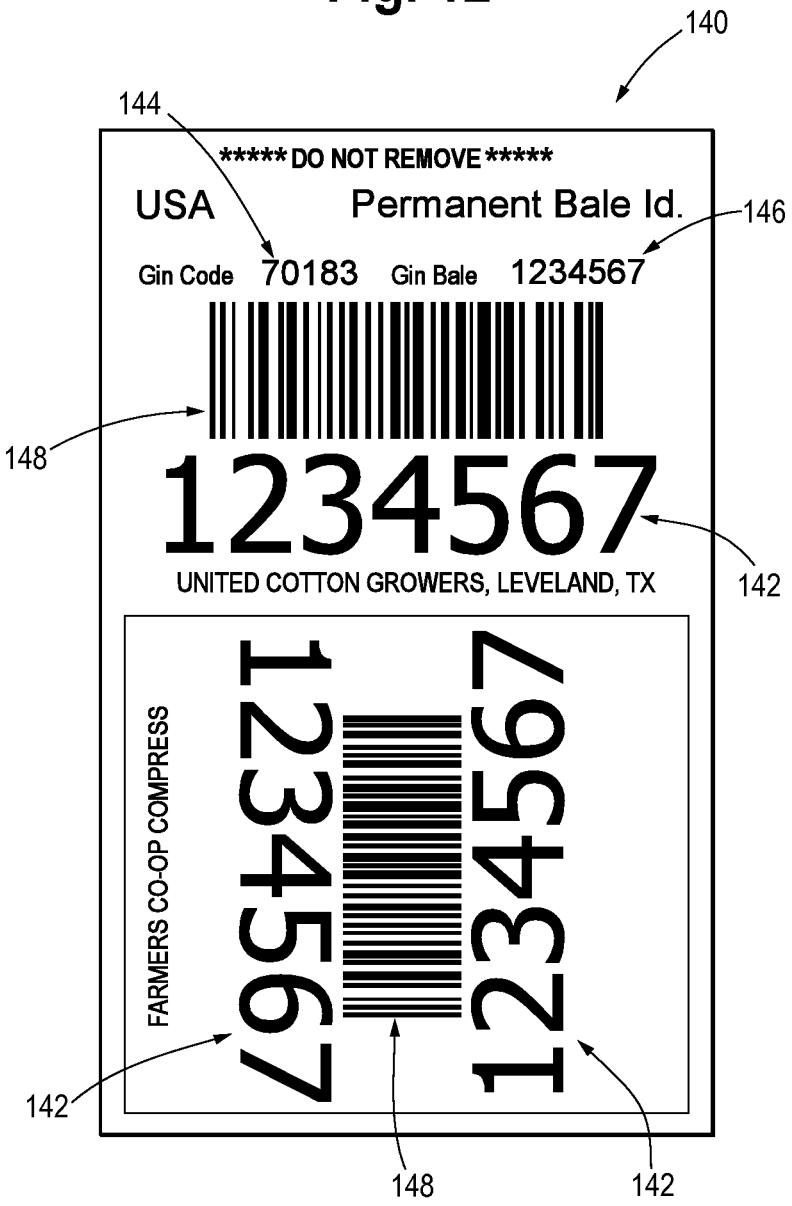
FIG. 12 is an exemplary label that can be disposed on the load in one embodiment.

The labeling operation of the bagging system 22 is described in its most elementary form above. In a more particular example, each load 22 is a cotton bale that is assigned a separate and distinct identification number 142 that is printed on the label 140, an example of which is seen in FIG. 12. The number 142 can be generated by an end user's computer or a stand-alone device that generates sequential numbers within a given range. Gin and bale numbers 144, 146, respectively, and other information, such as a barcode 148, are also received and the labeling system 80 prints and applies identical labels (one for each side of the bale 22) in a specified location on the bagged bale. These labels 140 will be used as permanent identification for the bale 22 through handling, warehousing, shipment, and use. In addition to the primary labels 140 being applied to the bale 22 by the labeling system 80, a third label can be printed on card stock using the same labeling system 80 or a separate printer located near an operator, for example. The operator receives the third label and puts it into a pouch with two samples manually extracted from each cotton bale. It is important that the third label matches correctly with the labels 140 applied to the bale 22 so that the samples are representative of the cotton in each bale. The samples are used by merchants to select individual bales for purchase and use in their textile operations. Samples are retained by the USDA through the time cotton is purchased and used as follow-up required in the event of poor quality or production problems in textile operations.

Figure 13:
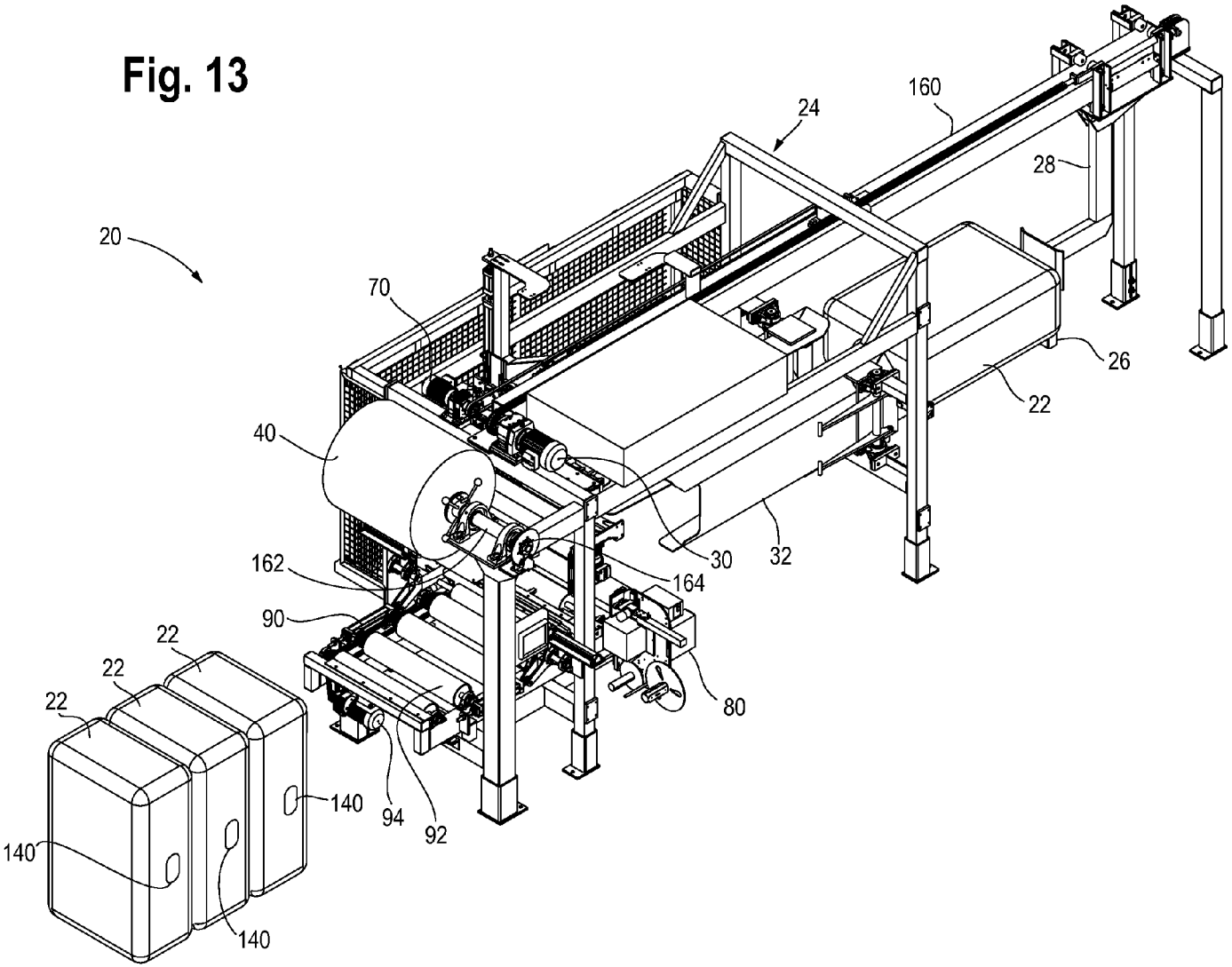
FIG. 13 is a perspective view of a bagging system in accordance with another embodiment of the present disclosure.

Referring now to FIG. 13, modifications to the bagging system 20 of FIG. 1 can be made without departing from the spirit and scope of the present disclosure. More particularly, the load pusher 28 can be mounted on an overhead rail 160 and actuated thereon to move the load 22 through the chute 32. Further, the bag spool 42 can be mounted on a shaft 162 that may be rotated by a motor 164 with a brake, as would be apparent to one of ordinary skill in the art.

It should be understood that various changes and modifications to the presently preferred embodiments disclosed herein will be apparent to those skilled in the art. Such changes and modifications can be made without departing from the spirit and scope of the present disclosure and without diminishing its intended advantages. It is therefore intended that such changes and modifications be covered by the appended claims.

The invention claimed is:

1. A load packaging system comprising:

a bag material feeder for pulling a length of bag material;

a mechanism for cutting and sealing the bag material to form a bag with a first sealed end;

a gripping device for opening the bag and guiding the open bag over a chute extending a longitudinal axis;

a load infeed table extending along the longitudinal axis; and fixed relative to the infeed table;

a load pusher for pushing the load into the bag along the longitudinal axis;

a package sealer for sealing a second end of the bag after receipt of the load in the bag;

a labeling device for printing and applying one or more labels onto the load; and a sensor to detect the presence and legibility of the label applied to the bag, wherein the label is applied to the bag after the load is received in the bag.

2. The system of claim 1, wherein the bag material is in the form of a continuous tube wound around a bag spool.

3. The system of claim 1, wherein the gripping device is a vacuum gripper that further pulls the bag over a chute, and wherein the load pusher is configured to push the load horizontally into the chute.

4. The system of claim 3, wherein the vacuum gripper includes first and second vacuum bars, each of which includes suctions cups, and wherein the first and second vacuum bars are mounted on a support arm and are capable of being moved generally vertically towards and away from one another, and further wherein the support arm is capable of being moved horizontally forward and backward with respect to the chute.

5. The system of claim 1, further comprising a second load pusher at an outfeed end of the system for shifting stacked loads away from the outfeed end.

6. The system of claim 1, wherein the infeed table and an outfeed table include powered rollers.

7. The system of claim 1, wherein the load is a cotton bale weighing between about 450 and 550 pounds.

8. A method for packaging a load utilizing an automated load packaging system, the load packaging system defining a longitudinal axis, the method comprising:

pulling a length of bag material;

cutting and sealing the bag material to form a bag with a first sealed end;

opening a second open end of the bag and guiding the open bag over a chute extending along a longitudinal axis;

placing a load on an infeed table that extends along the longitudinal axis and pushing the load along the infeed table and along the longitudinal axis' and into the load positioning chute fixed relative to the infeed table;

pushing the load into the bag along the longitudinal axis;

after pushing the load into the bag, sealing the second open end of the bag to create a bagged load as the load moves along the longitudinal axis;

printing and applying one or more labels onto the bagged load; and sensing the presence and legibility of the label applied to the bagged load.

9. The method of claim 8, wherein the bag material is in the form of a continuous tube wound around a bag spool.

10. The method of claim 8, wherein step of opening the second open end is performed by a vacuum gripper that further pulls the bag over a chute.

11. The method of claim 10, wherein the vacuum gripper includes first and second vacuum bars, each of which includes suctions cups, and wherein the first and second vacuum bars are mounted on a support arm and are capable of being moved generally vertically towards and away from one another, and further wherein the support arm is capable of being moved horizontally forward and backward with respect to the chute.

12. The method of claim 8, further comprising shifting stacked loads away from an outfeed end of the automated load packaging system.

13. The method of claim 8, further comprising placing the load on the infeed table, pushing the load along the infeed table into the bag, and conveying the load on an outfeed table with powered rollers until the load tips off of the outfeed table to a vertical rest position.

14. The method of claim 8, wherein the load is a cotton bale weighing between about 450 and 550 pounds.

* * * * *

UNITED STATES PATENT AND TRADEMARK OFFICE

CERTIFICATE OF CORRECTION

PATENT NO. : 9,156,575 B2
APPLICATION NO. : 13/347502
DATED : October 13, 2015
INVENTOR(S) : Michael W. Potempa et al.

It is certified that error appears in the above-identified patent and that said Letters Patent is hereby corrected as shown below:

Title page, Item (73), Assignee, line 1 "Grop" to read as --Group--.

In the Claims:

Column 6, line 65, Claim 1, "a" to read as --along a--.

Column 8, line 5 approx., Claim 9, "axis'" to read as --axis,--.

Signed and Sealed this
Twenty-third Day of August, 2016

Michelle K. Lee

Michelle K. Lee
*Director of the United States Patent and Trademark Office*